US009959807B2

(12) United States Patent
Lee

(10) Patent No.: US 9,959,807 B2
(45) Date of Patent: May 1, 2018

(54) ORGANIC LIGHT-EMITTING DISPLAY DEVICE AND DRIVING METHOD THEREOF

(71) Applicant: SAMSUNG DISPLAY CO., LTD., Yongin, Gyeonggi-Do (KR)

(72) Inventor: Wook Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 84 days.

(21) Appl. No.: 14/800,494

(22) Filed: Jul. 15, 2015

(65) Prior Publication Data

US 2016/0133175 A1 May 12, 2016

(30) Foreign Application Priority Data

Nov. 10, 2014 (KR) ..... 10-2014-0155520

(51) Int. Cl.

*G09G 3/20* (2006.01)
*G09G 3/32* (2016.01)
*G09G 3/3208* (2016.01)

(52) U.S. Cl.

CPC ... *G09G 3/3208* (2013.01); *G09G 2320/0233* (2013.01); *G09G 2320/0295* (2013.01); *G09G 2320/045* (2013.01)

(58) Field of Classification Search

CPC .. G09G 3/2003; G09G 3/3208; G09G 3/3283; G09G 2300/0452; G09G 2310/027; G09G 2310/0272; G09G 2320/0233; G09G 2320/0294; G09G 2320/045

See application file for complete search history.

(56) References Cited

U.S. PATENT DOCUMENTS 9,418,590 B2 * 8/2016 Park ..... G09G 3/2092
2009/0147856 A1 * 6/2009 Song ..... H04N 19/172 375/240.23
2011/0063283 A1 * 3/2011 Ryu ..... G09G 3/3283 345/214

(Continued)

FOREIGN PATENT DOCUMENTS

KR 10-2010-0125803 A 12/2010
KR 10-2011-0028752 A 3/2011

(Continued)

*Primary Examiner* — Abbas Abdulselam
*Assistant Examiner* — Jennifer Zubajlo
(74) *Attorney, Agent, or Firm* — Lewis Roca Rothgerber Christie LLP

(57) ABSTRACT

An organic light-emitting display device includes: a display panel; a deterioration threshold value calculator for calculating a deterioration threshold value from values of accumulated image data respectively input to the plurality of pixels; a current sensor for detecting a current amount flowing through pixels in one of first to nth display areas of the display panel in a power-off section of the display panel; and a deterioration amount calculator for defining a deterioration area including a group of pixels from among the pixels each having a value of image data that is equal to or greater than the deterioration threshold value among pixels in the first to nth display areas, and calculating a deterioration amount of the pixels in the deterioration area, wherein the current sensor is configured to detect a current amount flowing through pixels in one of the first to nth display areas in each power-off section.

15 Claims, 7 Drawing Sheets

(56) References Cited

U.S. PATENT DOCUMENTS

| | | | | |
|---|---|---|---|---|
| 2011/0210958 | A1* | 9/2011 | Yoo | G09G 3/325 345/214 |
| 2011/0216056 | A1* | 9/2011 | Yoo | G09G 3/32 345/212 |
| 2013/0027381 | A1* | 1/2013 | Nathan | G09G 3/3233 345/212 |
| 2014/0152720 | A1* | 6/2014 | Kim | G09G 3/3406 345/691 |
| 2014/0176401 | A1* | 6/2014 | Kim | G09G 3/3208 345/76 |
| 2014/0240377 | A1* | 8/2014 | Matsui | G09G 3/3406 345/690 |
| 2015/0062137 | A1* | 3/2015 | Yu | G09G 3/3233 345/531 |

FOREIGN PATENT DOCUMENTS

| | | | |
|---|---|---|---|
| KR | 10-2014-0080243 | A | 6/2014 |
| KR | 10-2014-0082498 | A | 7/2014 |

* cited by examiner

ORGANIC LIGHT-EMITTING DISPLAY DEVICE AND DRIVING METHOD THEREOF

CROSS-REFERENCE TO RELATED APPLICATION

This application claims priority to and the benefit of Korean Patent Application No. 10-2014-0155520, filed on Nov. 10, 2014, in the Korean Intellectual Property Office, the disclosure of which is incorporated herein in its entirety by reference.

BACKGROUND

1. Field

One or more example embodiments relate to an organic light-emitting display device and a method of driving the same.

2. Description of the Related Art

Recently, various categories of flat panel display devices have been developed to replace cathode ray tubes that are relatively heavy and have a large volume. Examples of the flat panel display devices include a liquid crystal display device, a field emission display device, a plasma display panel, and an organic light-emitting display device.

An organic light-emitting display device is a category of flat panel display device in which an organic compound is used as a light-emitting material and displays an image by using an organic light-emitting diode generating light due to the recombination of electrons and holes.

Organic light-emitting display devices may have a relatively high response speed and may be driven with relatively low power consumption. Organic light-emitting display devices may also have high quality luminance and color purity, and are relatively thin and lightweight. Accordingly, organic light-emitting display devices are expected to be useful in various applications of display devices such as portable display devices.

An organic light-emitting display device includes a plurality of pixels that display one of a plurality of colors including red, green, and blue colors, and emits light at a luminance corresponding to a data voltage applied to each of the plurality of pixels.

The plurality of pixels each include an organic light-emitting diode (OLED) and a pixel circuit that is coupled to a data line and a scan line to control the OLED, and the OLED emits light at a luminance corresponding to a driving current supplied by the pixel circuit.

The pixel circuit may include a plurality of transistors and a storage capacitor, and controls a driving current supplied to the OLED according to a data signal supplied to a data line when a scan signal is supplied to a scan line.

However, pixels of the organic light-emitting display device may not display images at a desired luminance due to changes in efficiency caused by deterioration of the OLEDs, and in fact, as time passes, the OLEDs may deteriorate such that light is emitted at a gradually decreasing luminance despite having identical data signal applied to the pixel.

SUMMARY

One or more example embodiments relate to an organic light-emitting display device and a method of driving the same. According to some embodiments, in an organic light-emitting display device and a method of driving the organic light-emitting display device, pixel sensing may be performed in a non-display section to reduce low viewability due to emission of an organic light-emitting device, and a deterioration amount may be calculated based on a difference in current amounts of a deterioration pixel and a non-deterioration pixel so that initial data may not be necessary to compensate for deterioration of the organic light-emitting device.

One or more example embodiments include an organic light-emitting display device and a method of driving the same, in which the influence of noise due to a display operation may be reduced in regard to determining a compensation amount corresponding to a luminance decrease due to deterioration of an organic light-emitting device.

One or more example embodiments include an organic light-emitting display device and a method of driving the same, whereby the time needed to detect a deterioration amount for compensation of deterioration may be reduced.

However, the one or more embodiments are only examples, and the scope of the present invention is not limited thereto.

Additional aspects will be set forth in part in the description which follows and, in part, will be apparent from the description, or may be learned by practice of the presented embodiments.

According to one or more example embodiments of the present invention, an organic light-emitting display device includes: a display panel including a plurality of pixels, wherein each of the plurality of pixels includes an organic light-emitting device configured to emit one of a plurality of colors including red, green, and blue; a deterioration threshold value calculator configured to calculate a deterioration threshold value from values of accumulated pieces of image data respectively input to the plurality of pixels; a current sensor configured to detect a current amount flowing through pixels in one of first to nth display areas of the display panel in a power-off section of the display panel; and a deterioration amount calculator configured to define a deterioration area including a group of pixels from among the plurality of pixels each having a value of accumulated pieces of image data that is equal to or greater than the deterioration threshold value among pixels in the first to nth display areas, and to calculate a deterioration amount of the pixels in the deterioration area, wherein the current sensor is configured to detect a current amount flowing through pixels in one of the first to nth display areas in each power-off section of the display panel.

The deterioration threshold value calculator may include a memory that stores values of accumulated pieces of image data respectively input to the plurality of pixels in the display panel, and may be configured to calculate a deterioration threshold value from the values of the accumulated pieces of image data stored in the memory.

The deterioration threshold value may be defined by an average of values of accumulated pieces of image data respectively input to the plurality of pixels.

The current sensor may sequentially sense the first to nth display areas.

The deterioration amount calculator may be configured to calculate a background current from current amounts detected from the plurality of pixels in the display panel.

The deterioration amount calculator may be configured to calculate a deterioration amount based on a difference between a current amount detected from pixels in the deterioration area and the background current.

The current sensor may be configured to detect a current amount flowing through pixels in one of the first to nth display areas after a predetermined time period has passed.

The current sensor may include a detection circuit configured to apply a predetermined voltage to the plurality of pixels in a power-off section of the display panel, and to detect a current amount flowing through the organic light-emitting device of the plurality of pixels according to the applied voltage.

The organic light-emitting display device may further include a deterioration compensator configured to provide a pixel in the deterioration area with deterioration compensation data.

According to one or more example embodiments of the present invention, in a method of driving an organic light-emitting display device, wherein the organic light-emitting display device includes a display panel including a plurality of pixels, wherein each of the plurality of pixels includes an organic light-emitting device that emits one of a plurality of colors including red, green, and blue, the method includes: storing image data respectively input to the plurality of pixels; calculating a deterioration threshold value from values of the image data; detecting a current amount flowing through pixels in one of first to nth display areas of the display panel in a power-off section of the display panel; and defining a deterioration area formed of a group of pixels from among the plurality of pixels each having a value of image data that is equal to or greater than the deterioration threshold value among the pixels in the first to nth display areas; calculating a deterioration amount of the pixels in the deterioration area; and determining a compensation amount corresponding to the deterioration amount.

The deterioration threshold value may be defined by an average of the values of the image data.

In the detecting of a current amount, the first to nth display areas may be sequentially sensed.

In the calculating of a deterioration amount, a background current may be calculated from current amounts detected from the plurality of pixels in the display panel.

In the calculating of a deterioration amount, a deterioration amount may be calculated based on a difference between a current amount detected from the pixels in the deterioration area and the background current.

In the detecting of a current amount, a current amount flowing through pixels in one of the first to nth display areas after a predetermined time period has passed after a power-off of the display panel may be detected.

These general and specific embodiments may be implemented by using a system, a method, a computer program, or a combination of the system, the method, and the computer program.

BRIEF DESCRIPTION OF THE DRAWINGS

These and/or other aspects will become apparent and more readily appreciated from the following description of the example embodiments, taken in conjunction with the accompanying drawings in which.

DETAILED DESCRIPTION

Figure 1:
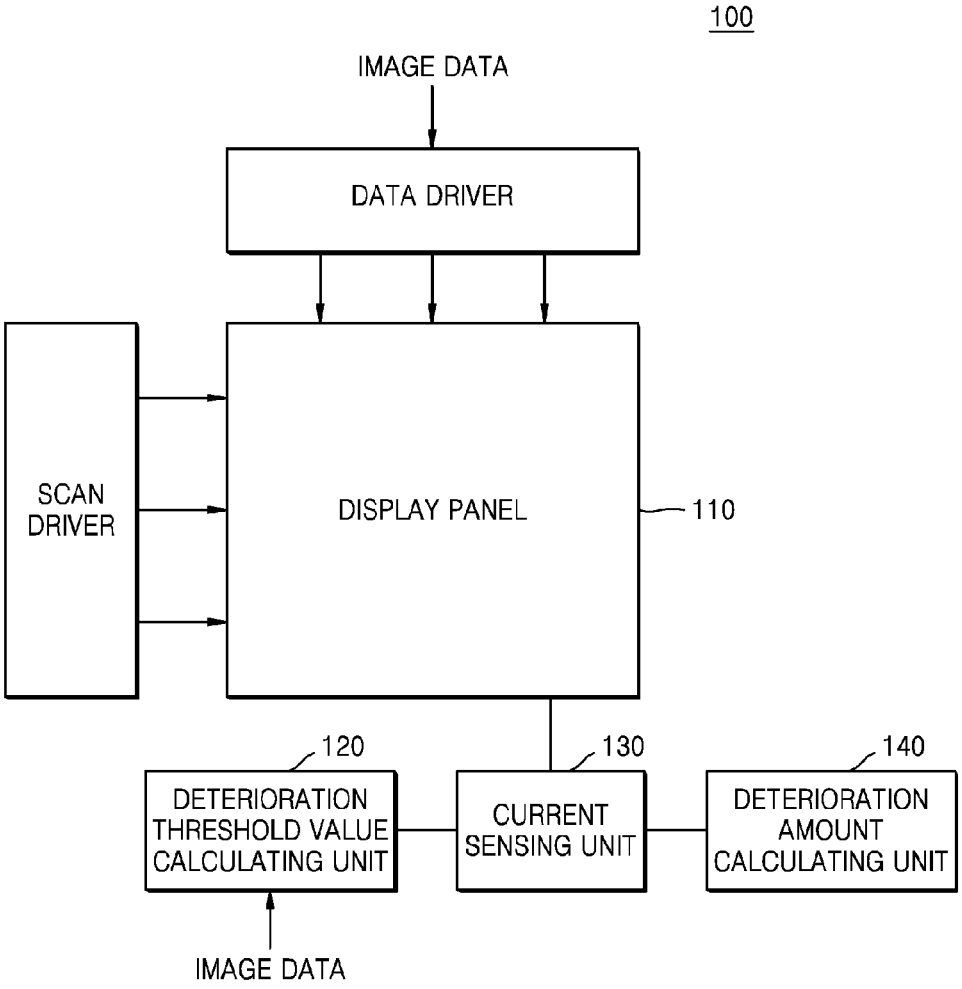
FIG. 1 is a schematic structural diagram illustrating an organic light-emitting display device according to some embodiments of the present invention.

Reference will now be made in more detail to example embodiments, examples of which are illustrated in the accompanying drawings, wherein like reference numerals refer to like elements throughout. In this regard, the present example embodiments may have different forms and should not be construed as being limited to the descriptions set forth herein. Accordingly, the example embodiments are merely described below, by referring to the figures, to explain aspects of the present description. As used herein, the term "and/or" includes any and all combinations of one or more of the associated listed items.

Because the present invention may have various modifications and several embodiments, example embodiments are shown in the drawings and will be described in some detail. Aspects, features, and a method of achieving the same will be specified with reference to the embodiments described below in more detail together with the attached drawings. However, the embodiments may have different forms and should not be construed as being limited to the descriptions set forth herein.

The embodiments of the present invention will be described below in more detail with reference to the accompanying drawings. Those components that are the same or are in correspondence are rendered the same reference numeral regardless of the figure number, and redundant explanations are omitted.

Singular expressions, unless defined otherwise in contexts, include plural expressions. In the embodiments below, it will be further understood that the terms "comprise" and/or "have" used herein specify the presence of stated features or components, but do not preclude the presence or addition of one or more other features or components.

It will be understood that although the terms "first", "second", etc. may be used herein to describe various components, these components should not be limited by these terms. These components are only used to distinguish one component from another. Singular expressions, unless defined otherwise in contexts, include plural expressions. In the embodiments below, it will be further understood that the terms "comprise" and/or "have" used herein specify the presence of stated features or components, but do not preclude the presence or addition of one or more other features or components.

FIG. 1 is a schematic structural diagram illustrating an organic light-emitting display device 100 according to an embodiment.

Referring to FIG. 1, the organic light-emitting display device 100 includes a display panel 110, a deterioration threshold value calculating unit 120, a current sensing unit 130, and a deterioration amount calculating unit 140.

The display panel 110 includes a plurality of pixels, and each of the plurality of pixels includes an organic light-emitting device that emits one of a plurality of colors including red, green, and blue colors.

The pixels display one of red, green, and blue colors, and a pixel displaying a red color, a pixel displaying a green color, and a pixel displaying a blue color may be sequentially and repeatedly arranged. Also, a user may perceive one color of light, in which red, green, and blue color light, which are displayed via adjacent pixels, are mixed.

Alternatively, the pixels may be formed of a red pixel, a green pixel, a blue pixel, and a white pixel that are adjacent to one another.

Also, each of the plurality of pixels includes an organic light-emitting device. When the organic light-emitting device emits light as a data signal of a maximum gradation level is applied to the pixels displaying red, green, and blue colors, light of red, green, and blue colors that are emitted from the pixels and are of a high gradation may be mixed and perceived as white light.

Alternatively, when the organic light-emitting device emits light as a data signal of a high gradation level is applied to each pixel displaying red and green colors, and a data signal of a low gradation level is applied to a pixel displaying a blue color, red color light, and green color light, which are output from the pixels and are of a high gradation, and blue color light, which is of a low gradation, may be mixed and perceived as yellow-based light.

The plurality of pixels may be arranged in the display panel 110 in a matrix at portions where scan lines arranged in rows and data lines arranged in columns cross each other. Each of the pixels receives a scan signal and a data signal respectively from the scan lines and the data lines.

A data driver of FIG. 1 supplies a data signal corresponding to image data to the pixels through the data lines in response to a data control signal.

Also, a scan driver generates a scan signal in response to a received scan control signal. Also, the scan driver may supply the generated scan signal to the pixels through the scan lines. The pixels may be sequentially selected row-by-row according to the scan signal to supply the data signal thereto.

The deterioration threshold value calculating unit 120 calculates a deterioration threshold value from values of accumulated pieces of image data respectively input to the plurality of pixels.

The pixels each receive a data signal corresponding to image data corresponding to each of the pixels from the data driver, and the deterioration threshold value calculating unit 120 accumulatively stores, for each pixel, pieces of image data respectively supplied to the plurality of pixels.

The pixels of the organic light-emitting display device 100 may not display desired images due to a change in efficiency caused by deterioration of the organic light-emitting device. In fact, as time passes, the organic light-emitting device deteriorates, and light is emitted at a gradually decreasing luminance according to an identical data signal.

Deterioration of the organic light-emitting device is caused by stress due to accumulation of pieces of data applied to individual pixels each including the organic light-emitting device, and the more pieces of accumulated data, the worse the degree of deterioration.

The deterioration threshold value is a threshold value for distinguishing a deterioration pixel from a non-deterioration pixel. The deterioration threshold value is calculated from values of image data accumulated in each pixel. The more pieces of data are applied to a pixel and are accumulated therein, the worse the degree of deterioration. Thus, based on the values of accumulated pieces of image data, a pixel, in which pieces of accumulated data have a value that is equal to or higher than the deterioration threshold value calculated may be distinguished as a deterioration pixel.

Likewise, a pixel, in which pieces of accumulated data have a value less than the deterioration threshold value, may be distinguished as a non-deterioration pixel.

The deterioration threshold value calculating unit 120 receives data of an image (image data) to be displayed on the display panel 110 to accumulate pieces of image data respectively input to the plurality of pixels.

The deterioration threshold value calculating unit 120 may include a memory that stores accumulative values of pieces of image data respectively input to the pixels in the display panel 110 and may calculate the deterioration threshold value from values of accumulated pieces of image data stored in the memory The memory may be a non-volatile memory and may accumulatively store pieces of data respectively applied to the plurality of pixels in the display panel 110.

The deterioration threshold value may be calculated from values of pieces of image data respectively applied to the plurality of pixels and accumulated therein; for example, the deterioration threshold value may be defined as an average of values of accumulated pieces of image data respectively input to the plurality of pixels.

In this case, the deterioration threshold value calculating unit 120 may determine the average of the values of accumulated pieces of image data respectively corresponding to the pixels as the deterioration threshold value, determine a pixel, in which pieces of accumulated data have a value that is equal to or higher than the deterioration threshold value, as a deterioration pixel, and a pixel in which pieces of accumulated data have a value that is less than the deterioration threshold value, as a non-deterioration pixel.

Defining a deterioration threshold value as an average of values of accumulated pieces of image data is an example, and the deterioration threshold value may be, for example, a mean value of the values of accumulated pieces of image data or a preset value according to an accumulated display time.

The current sensing unit 130 may divide the display panel 110 into first to nth display areas to detect a current amount flowing through pixels in one of the first to nth display areas in a power-off section of the display panel 110.

A current amount is detected from every pixel in the display panel 110, and the detected current amount may be used as a reference for detecting a deterioration amount of a deterioration pixel with respect to that of a non-deterioration pixel.

As described above, image data applied to the plurality of pixels is used in calculating a deterioration threshold value as a reference for distinguishing a deterioration pixel from a non-deterioration pixel, and it may be understood that the current amount detected by the current sensing unit 130 may enable calculation of a deterioration amount of a deterioration pixel.

The current sensing unit 130 detects a current amount in a power-off section of the display panel 110 because if current sensing is performed during a display operation, an exact current amount may not be detected due to noise of the display operation.

Noise due to a display operation may refer to measurement noise due to a temperature of an organic light-emitting device that emits light and/or due to electro-optical coupling noise. If a current amount is detected from a pixel that is emitting light, viewability may be degraded due to emission of a pixel.

Accordingly, the current sensing unit 130 may minimize the influence of noise due to a display operation by sensing current in a power-off section in which a driving voltage is not applied to the display panel 110.

Also, the current sensing unit 130 detects a current amount flowing through pixels in one of the first to nth display areas in each power-off section of the display panel 110.

The display panel 110 may be divided into the first to nth display areas, that is, a plurality of display areas, and the current sensing unit 130 may detect current amounts of all pixels in the first to nth display areas not all at once but detect a current amount flowing through pixels in one of the first to nth display areas in a power-off section of the display panel 110.

For example, a current amount of pixels in the first display area may be detected in a first power-off section of the display panel 110, and a current amount of pixels in the second display area may be detected in a second power-off section of the display panel 110.

That is, the current sensing unit 130 may sequentially sense the display area in each power-off section of the display panel 110, and a sensing order may be from the first display area to the nth display area as described, or in a random manner in which display areas are randomly selected.

In other words, the sensing order of the current sensing unit 130 is not limited, and current sensing may be performed on a display area in each power-off section of the display panel 110.

The deterioration amount calculating unit 140 defines a deterioration area formed of pixels each having a value of accumulated pieces of image data, equal to or greater than the deterioration threshold value, among pixels in the first to nth display areas, and calculates a deterioration amount of the pixels in the deterioration area.

As described above, the deterioration threshold value is a reference value for distinguishing a deterioration pixel from a non-deterioration pixel, and a pixel having a value of accumulated pieces of image data, equal to or greater than the deterioration threshold value, may be distinguished as a deterioration pixel.

Thus, an area formed of pixels that are distinguished as deterioration pixels may be distinguished as a deterioration area.

As deterioration of the organic light-emitting device proceeds, due to a decrease in efficiency, the organic light-emitting device emits light at lower luminance even when an identical amount of data voltage is applied, and a current amount measured from a deterioration pixel and a current amount measured from a non-deterioration pixel, to which an identical amount of data voltage is applied, are also different.

When an identical amount of data voltage is applied to pixels that emit light of the same color, a current amount measured from a deterioration pixel may be smaller than a current amount measured from a non-deterioration pixel.

Thus, a deterioration amount of a deterioration pixel may be calculated based on a difference in current amounts measured from the deterioration pixel and a non-deterioration pixel, and the deterioration amount calculating unit 140 calculates a deterioration amount of pixels in a deterioration area by using the above-described characteristics.

Figure 2:
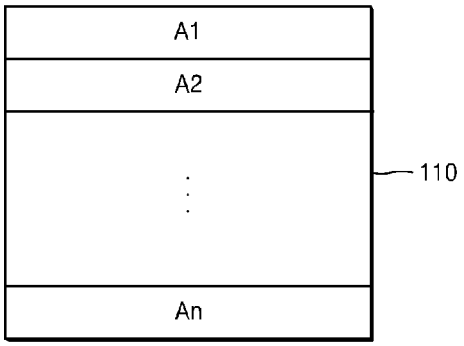
FIG. 2 illustrates an example of division of first to nth display areas of a display panel according to some embodiments of the present invention.

FIG. 2 illustrates an example of division of first to nth display areas of the display panel 110.

Referring to FIG. 2, the display panel 110 is divided into a plurality of display areas A1 to An.

The plurality of display areas A1 to An are virtual areas that divide the display panel 110, and no physical division lines that divide the display panel 110 into a plurality of display areas exist.

The plurality of display areas are a first display area A1, a second display area A2, and an nth display area An. The current sensing unit 130 described with reference to FIG. 1 senses a current amount from pixels in the first to nth display areas A1 to An in a power-off section of the display panel 110.

The current sensing unit 130 senses, for example, a current amount of pixels in the first display area A1 in a first power-off section of the display panel 110, and a current amount of pixels in the second display area A2 in a second power-off section of the display panel 110.

When the display panel 110 is divided into four display areas, for example, current amounts of all pixels in the display panel 110 may be sensed four times in four power-off sections of the display panel 110.

The number of display areas A1 to An may be differently determined according to a resolution or a size of a display panel. The higher the resolution, the more display areas a display panel may be divided into.

The higher the screen resolution, a longer time may be necessary to measure a deterioration amount of pixels to compensate for deterioration, and thus, in order to reduce the time needed to measure a deterioration amount, a display area may be divided into several sub-display areas, as illustrated in FIG. 2.

Figure 3A:
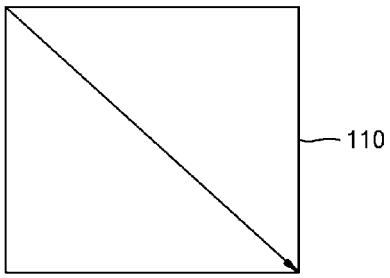
FIGS. 3A and 3B are schematic views illustrating a sensing operation for calculating a deterioration amount of a deterioration pixel according to some embodiments of the present invention.
Figure 3B:
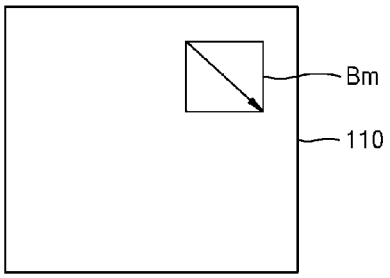

FIGS. 3A and 3B are schematic views illustrating a sensing operation for calculating a deterioration amount of a deterioration pixel.

First, FIG. 3A schematically illustrates an operation of calculating a deterioration amount of each pixel in the display panel 110. Although FIG. 3A illustrates that deterioration amounts of all pixels are calculated by one sensing operation performed on the display panel 110 for convenience of description, an actual sensing operation is performed, as described above with reference to FIG. 2, on one of a plurality of display areas of the display panel 110 in each power-off section of the display panel 110.

When a sensing operation is performed on the first to nth display areas (hereinafter, 'first sensing'), a current amount of every pixel in the display panel 110 is sensed, and the deterioration amount calculating unit 140 may calculate a background current from current amounts of a plurality of pixels in the display panel 110, which are detected by the first sensing.

The background current is a value calculated from a current amount that is predicted to have been sensed if a deterioration pixel had not deteriorated and a current amount sensed from a non-deterioration pixel, and may be calculated from a current amount sensed from a non-deterioration pixel located around the deterioration pixel.

A method of calculating the background current will be described in more detail with reference to FIG. 7.

FIG. 3B illustrates a second sensing operation on a deterioration area Bm.

The deterioration area Bm is an area formed of pixels each having a value of accumulated pieces of image data that is equal to or greater than a deterioration threshold value, and all pixels in the deterioration area Bm may be regarded as deterioration pixels.

The deterioration area Bm may be included in one of the plurality of display areas described with reference to FIG. 2, and the second sensing operation may be performed not only in a power-off section but also in a power-on section of the display panel 110. That is, when the second sensing operation is performed is not limited to a predetermined point.

When the deterioration threshold value calculating unit 110 calculates a deterioration threshold value, the deterioration amount calculating unit 140 defines a deterioration area Bm formed of pixels each having a value of accumulated pieces of image data that is equal to or greater than the deterioration threshold value, and the current amount sensing unit 130 senses a current amount flowing through the pixels in the deterioration area Bm.

A current amount flowing through pixels in the deterioration area Bm is first sensed in a current amount sensing operation (first sensing) performed on a display area, to which the deterioration area Bm belongs. In a second sensing operation illustrated in FIG. 3B, a current amount of pixels in the deterioration area Bm, that is, a current amount of a deterioration pixel, is sensed again.

Sensing of a current amount of the deterioration pixel may be performed twice, and the second sensing operation may be selectively not performed.

The current amount sensing unit 130 may include a detection circuit (not shown) to detect a current amount flowing through the plurality of pixels, and the detection circuit may be configured to apply a voltage of a predetermined amount to the plurality of pixels in a power-off section of the display panel 110 and detect a current amount flowing through the organic light-emitting device according to the voltage.

The detection circuit may be implemented as various configurations of circuits that measure a current amount flowing through the organic light-emitting device included in pixels in a power-off section of the display panel 110, that is, in a non-display section, and a method such as a correlated double sampling (CDS) method may be used, and the detection circuit is not limited to any particular circuit.

Figure 4:
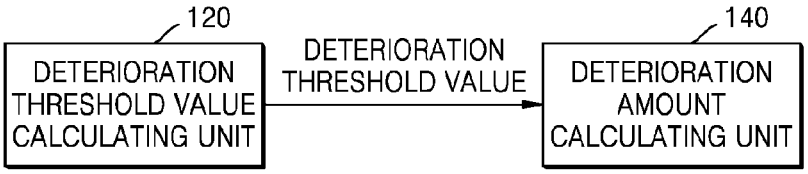
FIG. 4 illustrates a relationship between a deterioration threshold value calculating unit and a deterioration amount calculating unit according to some embodiments of the present invention.

FIG. 4 illustrates a relationship between the deterioration threshold value calculating unit 120 and the deterioration amount calculating unit 140 according to an example embodiment.

The deterioration amount calculating unit 140 calculates a deterioration amount of a deterioration pixel in the deterioration area, and a reference for classifying pixels as the deterioration pixel is a deterioration threshold value.

The deterioration threshold value is calculated by the deterioration threshold value calculating unit 120, and the deterioration amount calculating unit 140 defines a deterioration area formed of pixels each having a value of accumulated pieces of image data that is equal to or greater than the deterioration threshold value, and thus, the deterioration threshold value calculating unit 120 may provide the deterioration amount calculating unit 140 with information about the deterioration threshold value.

The deterioration amount calculating unit 140 may define a deterioration area formed of deterioration pixels by using the deterioration threshold value information provided by the deterioration threshold value calculating unit 120 and may calculate a deterioration amount of a deterioration pixel in the deterioration area by using a background current obtained by the first and second sensing operations of the current sensing unit 130.

Also, the deterioration threshold value calculating unit 120 may include a memory that stores cumulative values of pieces of image data respectively input to the plurality of pixels in the display panel 110 and may calculate the deterioration threshold value based on the values of accumulated pieces of image data stored in the memory.

The memory may be a non-volatile memory, and may cumulatively store pieces of data applied to the plurality of pixels in the display panel 110.

Figure 5:
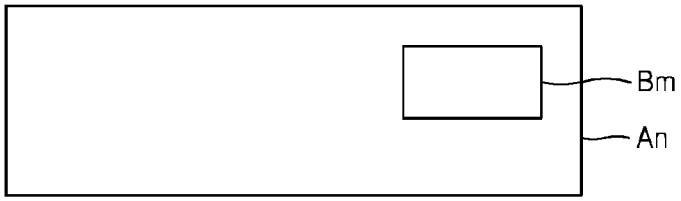
FIG. 5 illustrates a deterioration area included in a display area according to some embodiments of the present invention.

FIG. 5 illustrates a deterioration area included in a display area according to an example embodiment.

As described above, the deterioration area Bm is an area formed of pixels determined as deteriorated and may be defined within the plurality of display areas.

Although FIG. 5 illustrates that one deterioration area Bm is included in one display area An, this is example, and one or more deterioration areas B1 to Bm may be present in one display area An.

Figure 6:
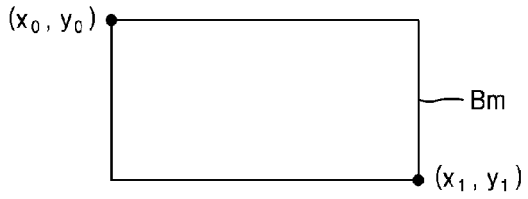
FIG. 6 illustrates a deterioration area used to calculate a deterioration amount of a deterioration pixel according to some embodiments of the present invention.

FIG. 6 illustrates a deterioration area used to calculate a deterioration amount of a deterioration pixel according to an example embodiment.

FIG. 6 illustrates coordinates of a starting point and an end point of a deterioration area Bm formed of deterioration pixels. Coordinates of the starting point of the deterioration area Bm is (x0, y0), and coordinates of the end point of the deterioration area Bm is (x1, y1).

The deterioration threshold value calculating unit 120 accumulatively stores, for each pixel, pieces of image data applied to the display panel 110 in order to calculate a deterioration threshold value. The deterioration threshold value calculating unit 120 may determine an amount of image data applied and accumulated in each pixel, by using coordinates information of each of the pixels.

The deterioration amount calculating unit 140 may receive deterioration threshold value information from the deterioration threshold value calculating unit 120 to determine a deterioration pixel among pixels in the display area and may define the deterioration area Bm by using coordinates information of the deterioration pixel.

Figure 7:
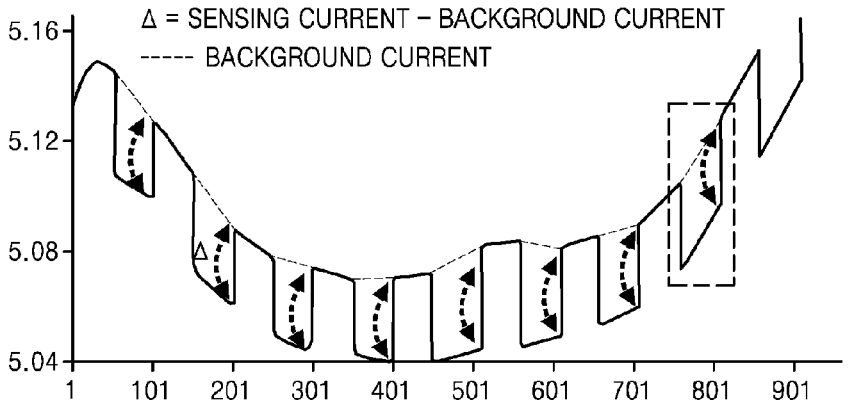
FIG. 7 is a graph showing a background current used to calculate a deterioration amount of a deterioration pixel, according to some embodiments of the present invention.

FIG. 7 is a graph showing a background current for calculating a deterioration amount of a deterioration pixel, according to an example embodiment.

The graph shown in FIG. 7 shows a current amount detected from a plurality of pixels located in one row of the display panel 110, and here, 1080 pixels are located in the one row.

Referring to the graph of FIG. 7, the detected current amount decreases toward to the middle of the one row, which is a pixel area where a current amount is less than peripheral pixels.

Current amounts of pixels of the above pixel area are reduced due to deterioration of the organic light-emitting device, and the pixels may form a deterioration area.

As deterioration of the organic light-emitting device proceeds, due to the increase in internal resistance of the organic light-emitting device, even if an identical amount of data voltage is applied to pixels, the organic light-emitting device emits light at a lower luminance, and a smaller current amount is detected from deteriorated pixels than from non-deterioration pixels.

The graph of FIG. 7 shows a total of nine deterioration areas, and pixels in the nine deterioration areas have values of accumulated pieces of image data that are equal to or greater than a deterioration threshold value. The eighth deterioration area is marked with a thick dashed line.

A thin dashed line couples two non-deterioration pixels at two ends of a deterioration area and may indicate a background current. A deterioration amount (Δ) may be defined as a value obtained by subtracting the background current from a current amount sensed from each pixel (sensing current).

The background current refers to a current that is predicted to have been sensed if a deterioration pixel in the deterioration area had not deteriorated, and a compensation amount for the deterioration pixel may be determined according to the deterioration amount (Δ).

The background current in the graph of FIG. 7 is marked with a line that connects current amounts sensed from non-deterioration pixels located at two edges of a deterioration area. However, this is an example for convenience of calculation of a background current, and the background current may be marked as a curve by considering a variation in a current amount sensed from a non-deterioration pixel.

After calculating the background current, a current amount predicted to have been sensed if each pixel in the deterioration area had not deteriorated may be calculated, and thus, a deterioration amount (Δ) and a deterioration compensation amount may be calculated from a difference between a current sensed from each deterioration pixel and the background current.

The current amount sensing unit 130 may sense a current amount flowing through pixels in the display panel 110 and provide the deterioration amount calculating unit 140 with information about the sensed current amount.

The deterioration amount calculating unit 140 may calculate a background current as illustrated in FIG. 7 from the information about the sensed current amount and may calculate a deterioration amount (Δ) from a difference between the current amount sensed from pixels in the deterioration area and the background current.

Although the method of calculating a background current from pixels in one row is described with reference to FIG. 7, the method may also be used to calculate a deterioration amount (Δ) regarding deterioration pixels that form a two-dimensional deterioration area.

For example, by coupling a current amount sensed from a non-deterioration pixel located just before the start coordinates (x0, y0) of the deterioration area Bm and a current amount sensed from a non-deterioration pixel located just next to the end coordinates (x1, y1) of the deterioration area Bm with a line, as illustrated in FIG. 7, a background current and a deterioration amount (Δ) corresponding to from the start coordinates to the end coordinates may be calculated.

When calculating a background current, current amounts sensed from the non-deterioration pixels located respectively before and after the start and end coordinates of the deterioration area, or current amounts sensed from a plurality of non-deterioration amounts may also be used.

For example, a background current may be calculated by using an average of current amounts sensed from five non-deterioration pixels located before start coordinates and an average of current amounts sensed from five non-deterioration pixels located after end coordinates.

While a compensation amount with respect to deterioration pixels is determined by using a difference between an initial current value and a current sensed after a predetermined time period has passed in a deterioration compensation system according to the related art, according to the organic light-emitting display device of the inventive concept, a difference between a current amount sensed from a deterioration pixel and a current amount sensed from a non-deterioration pixel is used, and thus initial data is not needed for compensating for deterioration of an organic light-emitting device.

Figure 8:
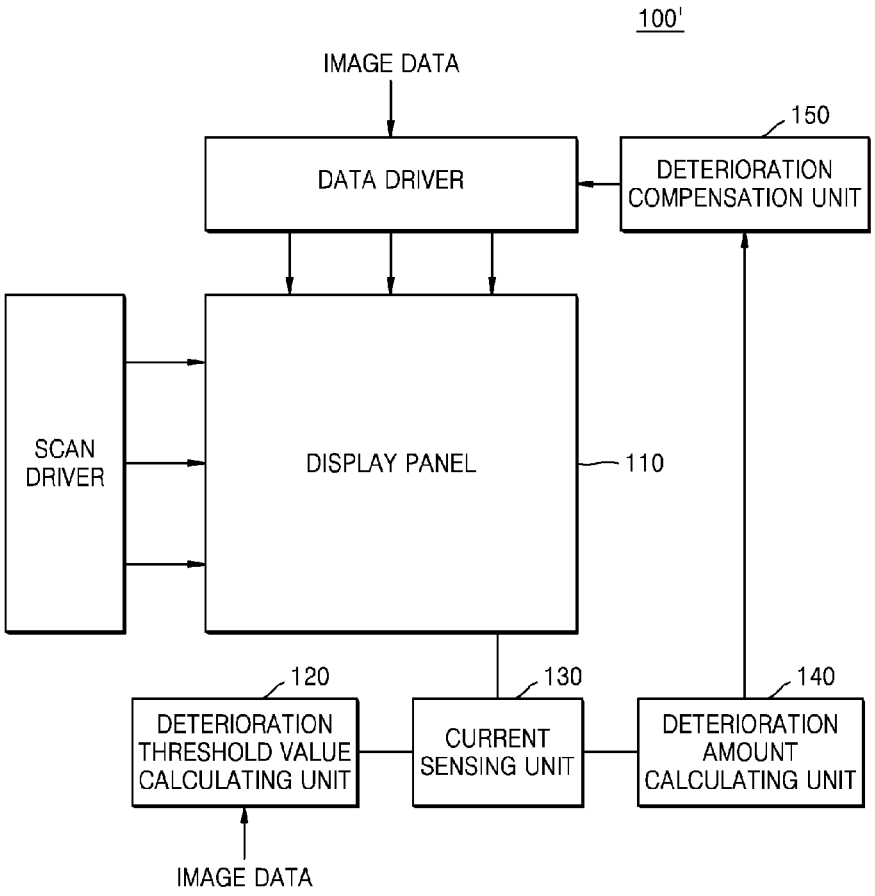
FIG. 8 is a schematic structural diagram illustrating an organic light-emitting display device according to some embodiments of the present invention.

FIG. 8 is a schematic structural diagram illustrating an organic light-emitting display device 100' according to another embodiment.

Referring to FIG. 8, the organic light-emitting display device 100' further includes a deterioration compensation unit 150, compared to the organic light-emitting display device 100 described with reference to FIG. 1.

The deterioration compensation unit 150 may provide deterioration compensation data to pixels in the deterioration area. The deterioration compensation unit 150 may provide the deterioration compensation data to a data driver, and the data driver provides, in response to a data control signal, a data signal corresponding to the deterioration compensation data to a plurality of pixels in the display panel 110 through data lines.

The deterioration compensation data provided by the deterioration compensation unit 150 may be a data voltage that allows a current corresponding to a background current, which corresponds to a position of a deterioration pixel, to flow to the deterioration pixel.

Alternatively, the deterioration compensation data may be image data corresponding to a sum of image data to be applied to a deterioration pixel and image data corresponding to a deterioration amount (Δ) of a deterioration pixel calculated by the deterioration amount calculating unit 140.

As a result, due to the deterioration compensation data provided by the deterioration compensation unit 150, a deterioration pixel may display an image at a uniform luminance regardless of deterioration of an organic light-emitting device of the deterioration pixel.

Figure 9:
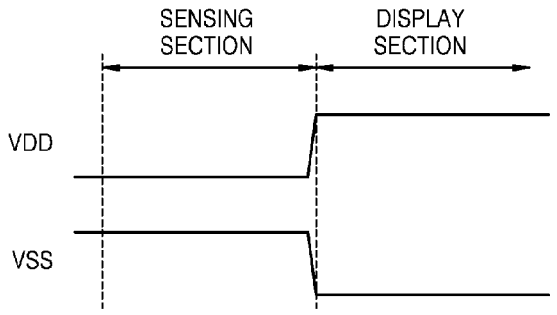
FIGS. 9 and 10 are timing diagrams illustrating a sensing section according to some embodiments of the present invention.
Figure 10:
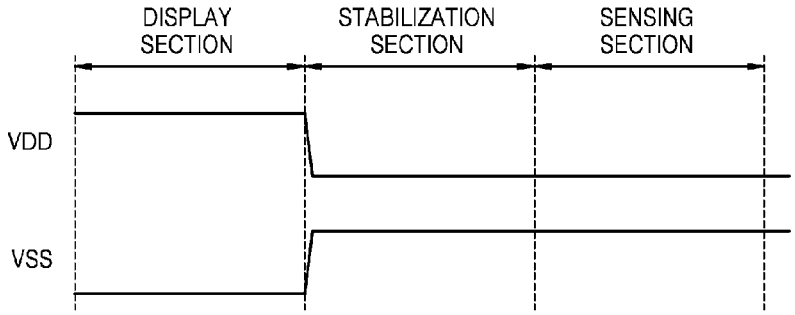

FIGS. 9 and 10 are timing diagrams illustrating a sensing section according to an example embodiment.

The graphs of FIGS. 9 and 10 show a display section and a sensing section according to a driving voltage VDD and a reference voltage VSS.

The driving voltage VDD supplies power whereby the display panel 110 of the organic light-emitting display devices 100 and 100' may display an image, and if the driving voltage VDD is low, power is not supplied to pixels in the display panel 110, and thus images may not be displayed.

In both graphs of FIGS. 9 and 10, the reference voltage VSS may be an initial ground voltage, and when the driving voltage VDD changes from low to high, the reference voltage VSS may drop from a ground voltage to a negative voltage, or may be a uniform ground voltage regardless of a change of the driving voltage VDD.

In the graph illustrated in FIG. 9, a sensing section is distinguished from a display section according to a change of a level of the driving voltage VDD. In the graph of FIG. 10, an additional stabilization section is included between the display section and the sensing section.

The sensing section is a section in which a current amount of a plurality of pixels in the display panel 110 is sensed, and sensing of the current amount is performed by the current amount sensing unit 130. As described above, the display panel 110 may be divided into a plurality of areas, and a current amount of each display area may be sensed in each power-off section of the display panel 110.

According to the organic light-emitting display device and the method of driving the organic light-emitting display device of the inventive concept, a current amount is sensed in a non-display section of the organic light-emitting display device, as shown in the graphs of FIGS. 9 and 10, to thereby minimize the influence of noise and temperature caused by a display operation and sense exact current amounts.

Figure 11:
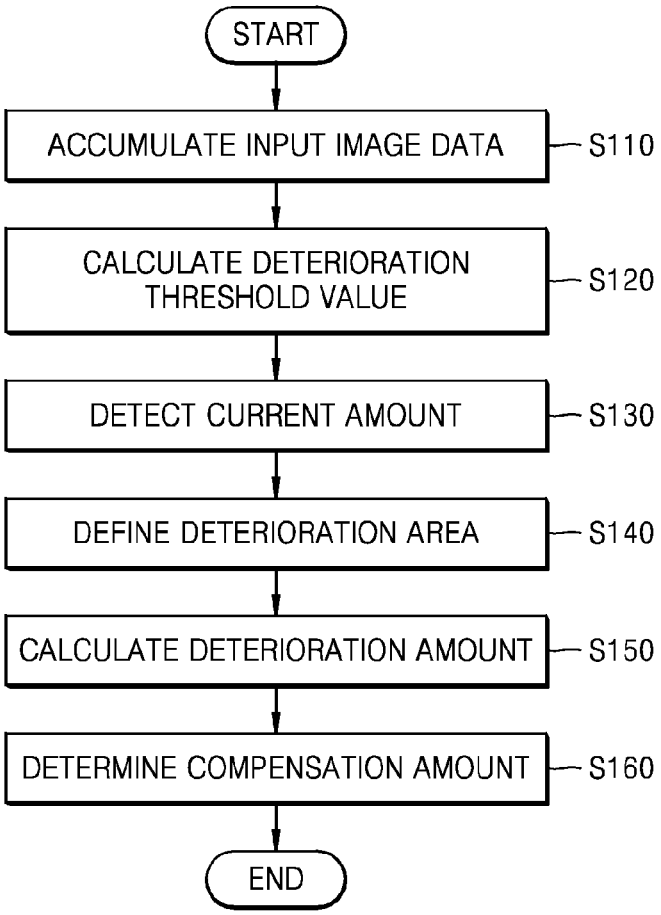
FIG. 11 is a flowchart of a method of driving an organic light-emitting display device according to some embodiments of the present invention.

FIG. 11 is a flowchart of a method of driving an organic light-emitting display device, according to an example embodiment.

The method of driving an organic light-emitting display device, according to an example embodiment, is a method of driving an organic light-emitting display device including a display device including a plurality of pixels, wherein each of the plurality of pixels includes an organic light-emitting device that emits light of one of a plurality of colors including red, green, and blue colors. The method includes accumulating pieces of input image data (S110), calculating a deterioration threshold value (S120), detecting a current amount flowing to pixels (S130), defining a deterioration area (S140), calculating a deterioration amount of a deterioration pixel (S150), and determining a deterioration compensation amount with respect to the deterioration pixel (S160).

The organic light-emitting display device may be the organic light-emitting display device 100 or the organic light-emitting display device 100' described with reference to FIGS. 1 through 10.

In operation S110, pieces of image data respectively input to the plurality of pixels are cumulatively stored. A memory may be used to store the pieces of image data, and the memory may be a non-volatile memory.

In operation S120, a deterioration threshold value is calculated from values of accumulated pieces of image data, and the deterioration threshold value may be defined as an average of the values of accumulated pieces of image data respectively input to the plurality of pixels.

In operation S130, the display panel may be divided into first to nth display areas, and a current amount flowing through pixels in one of the first to nth display areas is detected in a power-off section of the display panel.

Here, the first to nth display areas may be sequentially sensed or in a random order.

In addition, in operation S130, after a time period (e.g., a predetermined time period) has passed after the power-off section of the display panel, a current amount flowing through pixels in one of the first to nth display areas may be detected.

In operation S140, a deterioration area formed of pixels having values of accumulated pieces of image data that are equal to or greater than the deterioration threshold value among the pixels in the first to nth display area is defined.

In operation S150, a deterioration amount of the pixels in the deterioration area is calculated, and in operation S160, a compensation amount corresponding to the deterioration amount is determined.

In operation S150, a background current may be calculated from the current amounts detected from the plurality of pixels in the display panel, and the deterioration amount may be calculated based on a difference between the current amounts detected from the pixels in the deterioration area and the background current.

The background current is a reference for calculating a deterioration amount of pixels in the deterioration area, that is, of deterioration pixels, and may be a current that is predicted to have been detected if the deterioration pixels had not deteriorated.

The background current may be calculated from a current amount detected from a non-deterioration pixel located around the deterioration pixel. As shown in the graph of FIG. 7, the background current may be expressed by a dashed line that couples non-deterioration pixels or by a curve by taking into account a change in a current amount according to pixel positions.

The deterioration compensation amount determined in operation S160 may be a data voltage that allows a current corresponding to the background current, which corresponds to a position of the deterioration pixel, to flow to the deterioration pixel.

Alternatively, the deterioration compensation amount may be image data corresponding to a sum of image data to be applied to a deterioration pixel and image data corresponding to the deterioration amount (Δ) of the deterioration pixel calculated in operation S150.

As a result, the deterioration pixel may display an image at a uniform luminance regardless of deterioration of the organic light-emitting device based on the deterioration compensation amount.

As described above, according to the one or more of the above example embodiments, when determining a compensation amount corresponding to a decreased luminance due to deterioration of an organic light-emitting device, the influence of noise due to a display operation may be reduced.

Also, the time needed in sensing a deterioration amount for compensating for deterioration may be reduced.

It should be understood that the example embodiments described therein should be considered in a descriptive sense only and not for purposes of limitation. Descriptions of features or aspects within each example embodiment should typically be considered as available for other similar features or aspects in other example embodiments.

While one or more example embodiments have been described with reference to the figures, it will be understood by those of ordinary skill in the art that various changes in form and details may be made therein without departing from the spirit and scope as defined by the following claims.

What is claimed is:

1. An organic light-emitting display device comprising:

a display panel comprising a plurality of pixels, wherein each of the plurality of pixels comprises an organic light-emitting device configured to emit one of a plurality of colors comprising red, green, and blue;

a deterioration threshold value calculator configured to:

store, as accumulated image data for each of the pixels, information regarding image data supplied to the pixels; and calculate a deterioration threshold value based on an average of values of the accumulated image data respectively input to the plurality of pixels;

a current sensor configured to detect a current amount flowing through pixels in one of first to nth display areas of the display panel in a power-off section of the display panel; and a deterioration amount calculator configured to define a deterioration area comprising a group of pixels from among the plurality of pixels each having a value of the corresponding accumulated image data that is equal to or greater than the deterioration threshold value among pixels in the first to nth display areas, and to calculate a deterioration amount of the pixels in the deterioration area, wherein the current sensor is configured to detect a current amount flowing through pixels in one of the first to nth display areas in each power-off section of the display panel.

2. The organic light-emitting display device of claim 1, wherein the deterioration threshold value calculator comprises a memory that stores values of accumulated pieces of image data respectively input to the plurality of pixels in the display panel, and is configured to calculate a deterioration threshold value from the values of the accumulated pieces of image data stored in the memory.

3. The organic light-emitting display device of claim 1, wherein the deterioration threshold value is defined by an average of values of accumulated pieces of image data respectively input to the plurality of pixels.

4. The organic light-emitting display device of claim 1, wherein the current sensor sequentially senses the first to nth display areas.

5. The organic light-emitting display device of claim 1, wherein the deterioration amount calculator is configured to calculate a background current from current amounts detected from the plurality of pixels in the display panel.

6. The organic light-emitting display device of claim 5, wherein the deterioration amount calculator is configured to calculate a deterioration amount based on a difference between a current amount detected from pixels in the deterioration area and the background current.

7. The organic light-emitting display device of claim 1, wherein the current sensor is configured to detect a current amount flowing through pixels in one of the first to nth display areas after a predetermined time period has passed.

8. The organic light-emitting display device of claim 1, wherein the current sensor comprises a detection circuit configured to apply a predetermined voltage to the plurality of pixels in a power-off section of the display panel, and to detect a current amount flowing through the organic light-emitting device of the plurality of pixels according to the applied voltage.

9. The organic light-emitting display device of claim 1, further comprising a deterioration compensator configured to provides a pixel in the deterioration area with deterioration compensation data.

10. A method of driving an organic light-emitting display device, wherein the organic light-emitting display device comprises a display panel comprising a plurality of pixels, wherein each of the plurality of pixels comprises an organic light-emitting device that emits one of a plurality of colors comprising red, green, and blue, the method comprising:

storing, as accumulated image data for each of the pixels, information regarding image data respectively input to the plurality of pixels;

calculating a deterioration threshold value based on an average of values of the accumulated image data;

detecting a current amount flowing through pixels in one of first to nth display areas of the display panel in a power-off section of the display panel; and defining a deterioration area formed of a group of pixels from among the plurality of pixels each having a value of the corresponding accumulated image data that is equal to or greater than the deterioration threshold value among the pixels in the first to nth display areas;

calculating a deterioration amount of the pixels in the deterioration area; and determining a compensation amount corresponding to the deterioration amount.

11. The method of claim 10, wherein the deterioration threshold value is defined by an average of the values of the image data.

12. The method of claim 10, wherein in the detecting of a current amount, the first to nth display areas are sequentially sensed.

13. The method of claim 10, wherein in the calculating of a deterioration amount, a background current is calculated from current amounts detected from the plurality of pixels in the display panel.

14. The method of claim 13, wherein in the calculating of a deterioration amount, a deterioration amount is calculated based on a difference between a current amount detected from the pixels in the deterioration area and the background current.

15. The method of claim 10, wherein in the detecting of a current amount, a current amount flowing through pixels in one of the first to nth display areas after a predetermined time period has passed after a power-off of the display panel is detected.

* * * * *